US007448954B1

(12) United States Patent
Reynolds

(10) Patent No.: US 7,448,954 B1
(45) Date of Patent: Nov. 11, 2008

(54) BILLIARDS RACK

(76) Inventor: James R. Reynolds, 975 Pine St., Seekonk, MA (US) 02771

( * ) Notice: Subject to any disclaimer, the term of this patent is extended or adjusted under 35 U.S.C. 154(b) by 87 days.

(21) Appl. No.: 11/728,493

(22) Filed: Mar. 26, 2007

Related U.S. Application Data

(60) Provisional application No. 60/786,303, filed on Mar. 28, 2006.

(51) Int. Cl.
*A63D 15/00* (2006.01)
*A63F 9/24* (2006.01)

(52) U.S. Cl. ..... 473/40; 473/26

(58) Field of Classification Search ..... 473/1, 473/2, 4, 40, 26, 21; 33/286, 227
See application file for complete search history.

(56) References Cited

U.S. PATENT DOCUMENTS

| | | | | |
|---|---|---|---|---|
| 2,380,756 | A * | 7/1945 | Henry | 473/4 |
| 4,553,750 | A * | 11/1985 | Kintz | 473/40 |
| 6,371,860 | B1 * | 4/2002 | Anderson | 473/1 |
| 6,609,307 | B1 * | 8/2003 | Haynes et al. | 33/286 |
| 6,629,897 | B2 | 10/2003 | Belknap | |
| 7,165,332 | B2 * | 1/2007 | McGrail et al. | 33/286 |
| 2004/0132535 | A1 * | 7/2004 | Sumko | 473/2 |
| 2005/0239566 | A1 | 10/2005 | Nearhood | |

* cited by examiner

*Primary Examiner*—Mitra Aryanpour
(74) *Attorney, Agent, or Firm*—Robert J Doherty

(57) ABSTRACT

A billiard ball racking system including a rack housing light emitting means to project a pair of 180 degrees separated light beams into at least one light receiver means housed adjacent the side rail of a billiard table so as to assist the racking player in consistently producing a square rack which, when achieved, is visibly evident to the breaking player.

12 Claims, 3 Drawing Sheets

BILLIARDS RACK

This application claims the benefit of U.S. Provisional Patent Application Ser. No. 60/786,303 filed Mar. 28, 2006.

BACKGROUND OF THE INVENTION

1. Technical Field

The invention relates to pocket billiards equipment and the practice of racking the balls to begin a game. When introducing a new element to the game, the device should be compatible with the spirit and intent of the game. This invention positions the rack properly without adding any additional time or effort, yet enabling both players to quickly determine if the rack is positioned square to the table. The device of the present invention accomplishes this objective with all of the necessary components incorporated into the base member of the rack and beneath a presently unused part of the billiard table playing surface. The device makes use of a light source, power supply and switching all incorporated into the rack base member to precisely align the rack. The light beam activates two light absorbing receivers that glow at opposed lateral sides of the table and are visible at both the head and foot ends of the table when the rack is accurately aligned thus assuring both players that a perfect rack has been achieved.

2. Background Information

Most billiards games require the billiard balls to be racked at the foot side of the table. A rack is typically a grouping of balls in a triangle or diamond shape that is squared to the table with the lead ball positioned directly over the foot spot. In the past, the rack was positioned and aligned by hand and eye judgment of the player racking the balls. The player breaking the rack does not know for certain if the rack is perfectly square to the table. The rack device of the present invention conveys to both players when the rack is properly positioned, i.e., squared to the table, without distractions such as noises or bright light eye contact thus fitting into the spirit of the game.

BRIEF SUMMARY OF THE INVENTION

A rack for a billiard table which includes a power supply, two light beams 180 degrees apart with a momentary button that, when activated projects two light beams at two receivers that incorporate light absorbing material portions visible from at least the head rail of the table and preferably from both table ends, i.e., the head rail and foot rail table ends. If the rack is properly aligned, the light beam shines upon, into or through the light absorbing material. The light absorbing material glows at both ends of the receiver allowing both the player racking the balls and the player breaking the rack to see if the rack is properly aligned thus simplifying the racking and breaking process with one small laser assembly positioned in the base member of the rack and two receivers. The two receivers are located in a space on the billiard table that is not utilized during normal competition and therefore do not interfere with such play. The present invention enables each player to rack better and more consistently for their opponent thus assuring a level playing field for both players without changing the spirit and intent of the game.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
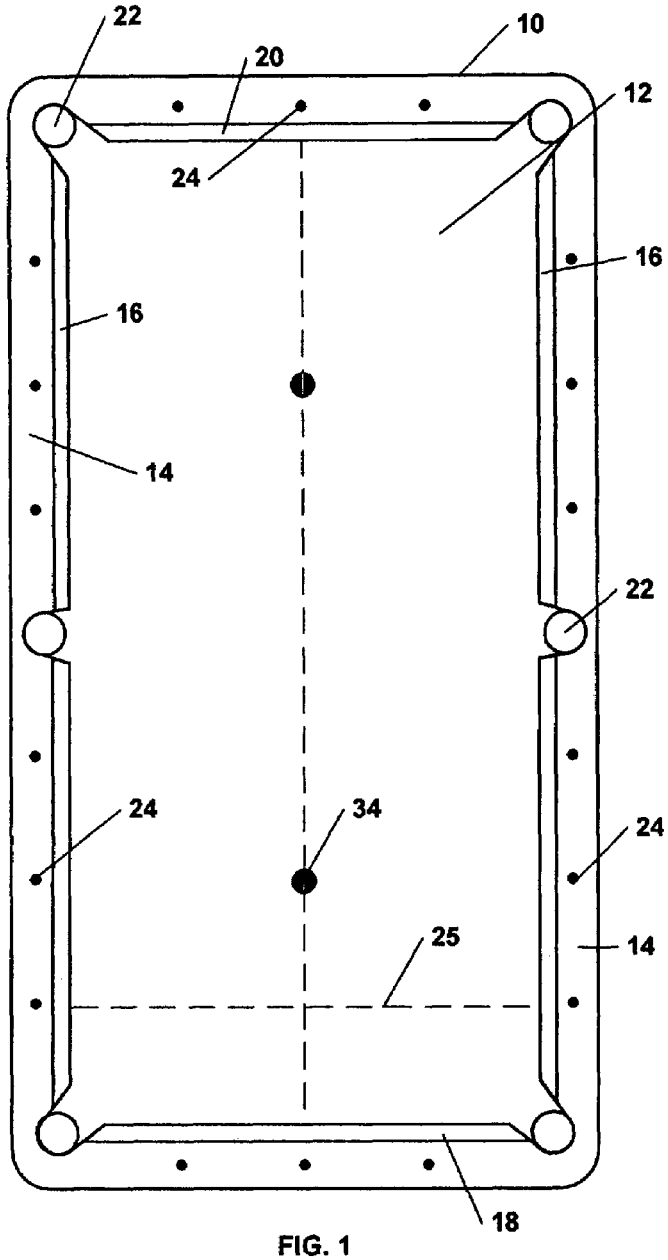
FIG. 1 is a top plan view of a billiards table.
Figure 2:
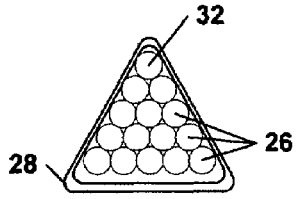
FIG. 2 is a top plan view of a billiards rack with balls.

Turning now to the drawings and particularly FIG. 1, a typical billiard table 10 is depicted that includes a playing surface 12, the top of the table 14, two side rails 16, a foot rail 18 and a head rail 20. The table 10 also includes a plurality of pockets 22 with alignment markers 24 aligned and equally spaced between the pockets 22 on billiard tabletop 14. Alignment markers are a means to aid the player racking the balls 26. The player 30 racking the balls and positioning the rack at the foot rail side 18 of the table places the balls 26 in the rack 28. After the balls 26 are racked, the player 30 moves or slides the rack 28 so as to position the forward ball 32 over the foot spot 34. The foot spot 34 is utilized as the front pivot point of the rack 28. To finish squaring the rack 28 to the table 10, the player 30 can use alignment marks 24 to create an imaginary line to square the base member of the rack 28 to the table, that is, position the back member of the rack in a parallel position to the table foot rail.

The problem associated with positioning the rack visually by the human eye as above described is that such prior art procedure does not eliminate or remove the many variables between different players. Although player 30 is racking the billiard balls, it is the breaking player 36 that requires a consistently square rack. If the rack 28 is not consistently square to the table 10, player 36 will obtain different results each time. The breaking player 36 cannot consistently judge the results of his/her first breaking shot of any game accurately when these variables exist.

The embodiment of the billiard rack two-player visual indicator system of the present invention is indicated in FIGS. 3-8 and comprises a rack 28 including two side members 60 and a base member 62. The base member houses a switch 66 and a power supply 68 as well as a light source 70. Generally, these components are housed in pockets or recesses formed in the base member 62. Such base member is preferably formed of two pieces of wood or other suitable material either removably or permanently assembled together once the power supply, light sources, switching, etc. are positioned therein. It should be pointed out that the side members 60 may also extend below the base member should other shaped racks, e.g., a diamond-shaped rack, be desired.

Figure 4:
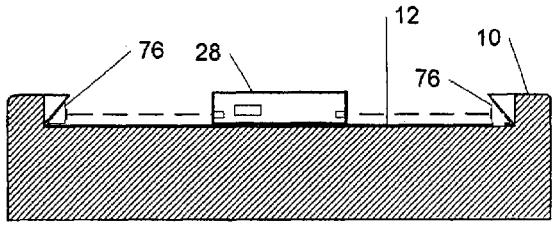
FIG. 4 is a foot rail side sectional view along the line 4-4 of FIG. 3 showing the rack and the receiver in relation to the table.
Figure 3:
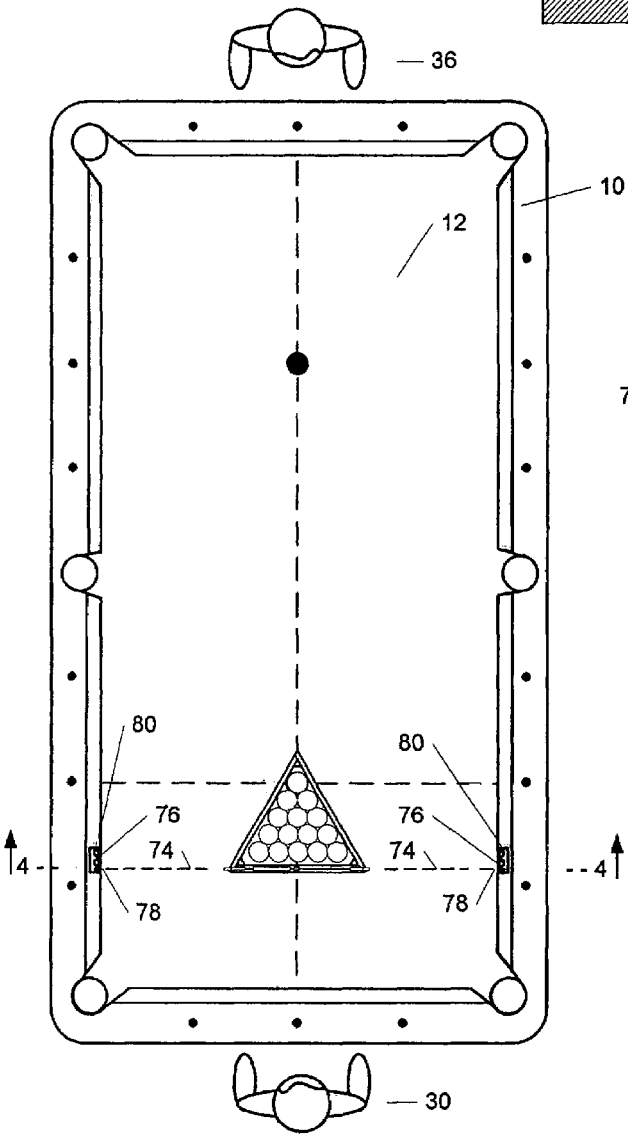
FIG. 3 is a top view of a billiards table with the rack system of the present invention and two players.

The light source is preferably a pair of light emitting diodes to create laser type light beams or similar light beam creating devices that are generally coupled with a focusing lens 72. If the player racking the billiard balls 30 pushes the momentary switch 66, two light beams 74 project two parallel laser beams (dots) at the beam absorber 78 housed in the receiver body 76. The switch 66 can be mounted so as to be accessible from the top surface of the rack as by manual activation by the racking player or mounted so as to include an activation button that projects below the bottom surface of the rack such that when the rack is placed on the table the switch is activated automatically during the racking process. The receiver housing 76 is mounted under an unused portion of the table side rails 16 as depicted in FIG. 4.

Figure 5:
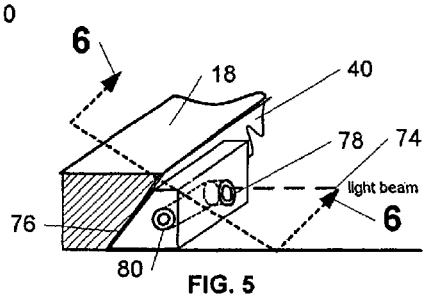
FIG. 5 is a partial perspective view of a table side rail portion with a light receiver positioned there against.
Figure 6:
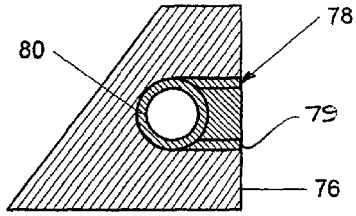
FIG. 6 is a receiver side sectional view along the line 6-6 of FIG. 5 showing a light receiver.
Figure 7:
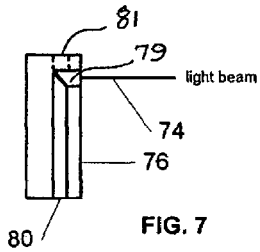
FIG. 7 is a stylized top plan view of the receiver showing the light path.
Figure 8:
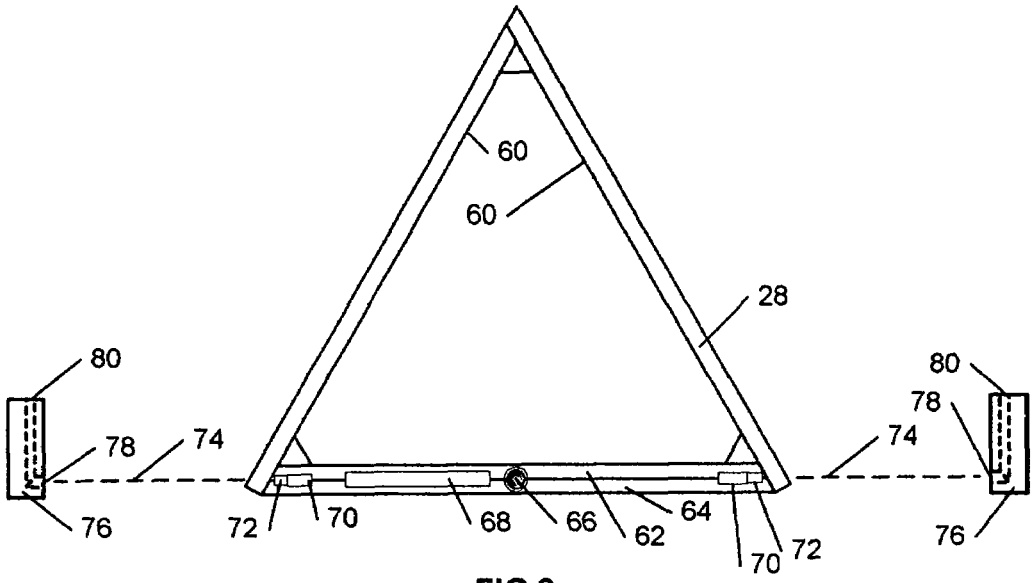
FIG. 8 is a stylized top plan view of the rack and light receivers with portions of the rack base member removed for clarity.

The light receiver housing 76 is adjusted by first squaring the rack 28 with a rule or similar gauge to table 10 then positioning the receiver housing 76 under side rail 16 in the proper position which corresponds to the distance between the foot spot and the base member of the rack as will be more evident below. The beam absorber 78 may be a tube, that is, hollow in the center, and including a light absorbing exterior. The beam absorber 78 can be constructed of soft plastic tubing or other similar material including polyurethane. Satisfactory results where achieved with ¼ inch O.D. polyurethane tubing of 0.062 wall thickness provided by Freelin Wade Co. under the brand name Fre-Thane. Such Fre-Thane material was colored red and created bright glowing red signals of annular shape visible to both players at the respective ends 79 and 80 of the tube 78. Tubes or even solid rods of light absorbing material of other colors can be utilized as can laser light beams of varying colors as well. When the light beam 74 is perfectly centered in the entry beam absorber end 79 as depicted in FIG. 5, the outside of the tube glows brightest at such end 79 and at the beam absorber head rail or exit side 80. FIG. 6 depicts the light path in receiving receiver housing 76. When the beam absorber 78 glows brightest at the ends 79, 80 thereof, this simultaneously confirms to both players that the rack 28 is perfectly aligned to the table 10. This system thus assures a more even playing field every game for both the player racking the balls 30 and the player breaking the balls 36. The back cover 64 encloses and seals the base member of the rack 28 as depicted in FIG. 7.

Accordingly, this improved two-player racking system is simple because players normally look left to right on the table at the alignment markers to square the back of the rack to the foot rail. By providing a light source in the same direction keeps the players' perspective the same. Moreover, the device of the present invention is considered a two-player system since the breaking player is really the player expecting a consistently square rack since he/she has the first breaking shot of the game and the manner the game unfolds is determined by that initial breaking shot. By primarily absorbing the light beam rather than projecting the light beam provides for a more pleasant and safe atmosphere although it should be pointed out that some light projection could accomplish a visible signal to the players should aesthetics not be a primary concern. It should also be noted that in some cases it may advantageous to modify the resultant L-shaped configuration of the tube 78 (in essence created by inserting two shaped pieces of tubing 78 into a pair of perpendicularly oriented bores provided in the housing 76 such that those tubing pieces contact each other to form such L-shaped light path configuration) to a T-shaped configuration where a part of the exit portions of the tube extends to the outer surface of the housing facing the foot rail side of the table such as shown by the dotted lines in FIG. 7 which would form a second annular shaped light path exit end 81. Additionally since the light and power assemblies are mounted in the base member of the rack, the rack's general appearance and/or balance remain unchanged. This improvement, which achieves all the enumerated objectives set forth above, adds a new dimension to the art by providing both players the same consistent starting point.

Moreover, the description and illustration of the invention is by way of example and the scope of the invention is not limited to the exact details shown or described.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A ball racking system for positioning billiards balls squarely on a billiards table having opposed foot and head rail ends and a pair of opposed side rails at one end thereof such that a player positioned at the opposite end of the table can visually observe when the rack is square to the table comprising a rack having a base member of longitudinal extent having opposite ends and a pair of side members extending from the ends thereof, said base including light means for projecting a pair of light beams 180° apart from said base and a pair of light receivers positioned on opposite sides of the table for both receiving said light beams and providing a light signal visible from the other end of the table only when said rack is squared with respect to the table.

2. The ball racking system of claim 1, wherein said light receivers are positioned beneath the side rail of the table, said light receivers including an elongated tube positioned parallel to said table side rail and having an inlet opening for receiving said light beams at one end thereof and a light absorbing portion visible from the other end of the table at the other tube end.

3. The ball racking system of claim 2, wherein said light receiving tube is provided with a light absorbing material.

4. A billiards ball racking system for a billiards table having interconnected head, foot and side rails comprising a rack for containing the balls to be racked, said rack having a base member adapted to be positioned parallel to the foot rail of the table and having means mounted therein for projecting a pair of light beams that are disposed 180° apart from each other in opposite directions therefrom, and a pair of light beam receiver assemblies mounted on opposite sides of the table, said light beam receiver assemblies adapted to receive light from said beams and redirect such light so as to be visible from the head rail of the table when said rack base member is positioned parallel to the table foot rail.

5. The billiards balls racking system of claim 4 wherein each of said light beam receiver assemblies comprises a tube positioned so as to receive one of said light beams at one end of said tube and transfer said light to the other tube end which other tube end is visible from said table head rail.

6. The billiards ball racking system of claim 5 wherein said tube is hollow and said other end thereof visibly glows when light enters said one tube end.

7. The billiards ball racking system of claim 5 wherein said tube is of a light absorbing material.

8. The billiards ball racking system of claim 5 wherein said tube is polyethylene.

9. The billiards ball racking system of claim 5 wherein each said light beam assembly comprises a housing positioned beneath the tube side rails, said housing adapted to position said tube parallel to the side rail under which it is positioned and further having an opening for directing one of said light beams into said one end of said tube.

10. The ball racking system of claim 4, wherein said rack base member includes a light source system including a pair of separate light emitting means at the opposite ends thereof, a power source for said light emitting means and an activation switch for said power source.

11. The ball racking system of claim 10, said base member having separate upper and lower members in face-to-face disposition and forming a series of receiving pockets for said light source system.

12. The ball racking system of claim 11, wherein said activation switch downwardly projects from the said rack base member so as to activate said light emitting means by contact with the table where the rack is positioned on the table.

* * * * *